US006216431B1

(12) United States Patent
Andrews

(10) Patent No.: US 6,216,431 B1
(45) Date of Patent: Apr. 17, 2001

(54) COMPOSITE YARN WITH THERMOPLASTIC LIQUID COMPONENT

(75) Inventor: Mark A. Andrews, Concord, NC (US)

(73) Assignee: World Fibers, Inc., Concord, NC (US)

( * ) Notice: Subject to any disclaimer, the term of this patent is extended or adjusted under 35 U.S.C. 154(b) by 0 days.

(21) Appl. No.: 09/255,922

(22) Filed: Feb. 23, 1999

Related U.S. Application Data

(63) Continuation of application No. 08/027,395, filed on Mar. 8, 1993, which is a continuation-in-part of application No. 07/981,282, filed on Nov. 25, 1992, now abandoned.

(51) Int. Cl.[7] ..... D02G 3/02

(52) U.S. Cl. ..... 57/210; 57/230; 428/364; 428/373; 428/377; 428/378; 428/394

(58) Field of Search ..... 57/210, 212, 213, 57/214, 216, 217, 218, 220, 221, 222, 223, 230, 232; 428/364, 370, 375, 378, 377, 373, 394

(56) References Cited

U.S. PATENT DOCUMENTS

| | | | | |
|---|---|---|---|---|
| 3,490,224 | | 1/1970 | Bourgeas . | |
| 4,321,854 | | 3/1982 | Foote et al. . | |
| 4,384,449 | | 5/1983 | Brynes, Sr. et al. . | |
| 4,470,251 | | 9/1984 | Bettcher . | |
| 4,651,514 | | 3/1987 | Collett . | |
| 4,777,789 | | 10/1988 | Kolmes et al. . | |
| 4,818,587 | | 4/1989 | Ejima et al. . | |
| 4,838,017 | | 6/1989 | Kolmes et al. . | |
| 4,912,781 | | 4/1990 | Robins et al. . | |
| 4,936,085 | | 6/1990 | Kolmes et al. . | |
| 5,010,723 | | 4/1991 | Wilen . | |
| 5,070,540 | * | 12/1991 | Bettcher et al. | 57/210 |
| 5,119,512 | | 6/1992 | Dunbar et al. . | |
| 5,177,948 | * | 1/1993 | Kolmes et al. | 57/230 |
| 5,248,548 | * | 9/1993 | Toon | 57/210 |
| 5,287,690 | * | 2/1994 | Toon | 57/210 |
| 5,423,168 | * | 6/1995 | Kolmes et al. | 57/230 |
| 5,644,907 | * | 7/1997 | Kolmes et al. | 57/230 |

* cited by examiner

*Primary Examiner*—John J. Calvert
*Assistant Examiner*—Gaby L. Welch
(74) *Attorney, Agent, or Firm*—Christopher C. Dremann

(57) ABSTRACT

A composite yarn formed of melt-fusible thermoplastic fibers combined with selected other fibers and/or materials includes a containment barrier that encapsulates one or more core materials which may present a threat of contamination to workers and/or the environment. The composite yarn includes a core covered by an adhesive layer of thermoplastic material which forms a containment barrier, combined with one or more subsequent overlying layers of fibers wrapped or otherwise applied thereto using conventional yarn construction methods. In a preferred embodiment the core material is coated with a liquid adhesive, and preferably a polyester-based polyurethane which contains silicon grit, just prior to being wrapped with one or more layers of fibers which form the containment barrier. The cured and finished composite yarn is designed for knitting and weaving fabrics, or for otherwise forming cordage and non-woven products. The composite yarn also is utilized to produce end products such as cut-resistant apparel for environments where workers are exposed to possibly contaminated products or where core materials in the yarn can damage the end product of manufacture.

13 Claims, 5 Drawing Sheets

COMPOSITE YARN WITH THERMOPLASTIC LIQUID COMPONENT

CROSS REFERENCES TO RELATED APPLICATIONS

This application is a continuation of co-pending U.S. patent application Ser. No. 08/027,395 filed Mar. 8, 1993, which is a continuation-in-part of U.S. patent application Ser. No. 07/981,282 filed Nov. 25, 1992, and now abandoned, the disclosures of which are incorporated herein by reference.

BACKGROUND AND SUMMARY OF THE PRESENT INVENTION

The present invention is related to cut-resistant yarns and associated fabrics, cordage, or non-woven products, which may be produced with the yarn. It is also related to static dissipative materials, materials reinforced for strength, and abrasion-resistant materials. Most particularly, the present invention is related to the above products when containment of a core material is required due to the potential for hazard to the employee, product, or environment if the core material is exposed.

There has been significant activity in recent years with regard to the manufacture of yarns and fabrics for cut-resistant protective apparel. Many of these activities deal with the use of stainless steel wire in conjunction with various fibers to attain an optimal balance of cut resistance and flexibility, coupled with cost of production.

U.S. Pat. No. 4,384,449 to Byrnes, Sr., et al. teaches the use of a longitudinally positioned wire strand covered with aramid, and the numerous resulting advantages of such wrapped wire. One advantage is superior cut resistance performance, when compared to gloves formed of pure aramid. Byrnes, Sr. also describes improved knitability on a conventional glove knitting machine, and improved dexterity of a glove knitted from such a wire yarn.

U.S. Pat. No. 4,470,251 to Bettcher extends the teachings of the above-mentioned Byrnes, Sr. patent by illustrating two primary discoveries. First, that two or more smaller wire strands yield greater flexibility than one strand, while allowing a larger quantity of wire to be used, and the use of a longitudinally positioned fibrous strand incorporated with the wire strands further improves flexible movement. Second, Bettcher demonstrates that an outer covering formed of a polyamide, such as nylon, improves the comfort of the glove to the wearer.

Kolmes/Plemmons, in U.S. Pat. Nos. 4,838,017 and 4,777,789, teach the wrapping of annealed stainless steel wire about a core fiber; wrapping the strands of wire in opposing directions and further increasing flexibility of the fabric while maintaining cut protection. Kolmes/Plemmons also documented a broad range of fibers that can be used in the core and outer wraps of the composite yarn.

The established prior art referenced here offers teachings that have improved the state of protective apparel. While each is representative of improvement, the present invention extends far beyond these prior teachings and demonstrates a novel and unique approach which solves a serious and heretofore unaddressed issue related to the manufacture of protective apparel. One previously unrecognized problem is the fact that in the use of wire composite yarns, the wire strands frequently break, puncturing the skin of the wearer, contaminating various manufacturing and production operations, and exposing the wearer to the possibility of disease. Wire will invariably fracture after repeated flexure and will penetrate the surface of any known composite yarn.

The present inventor has discovered that the invention taught herein provides a method of containing wire and other materials such as fiberglass when these materials are used as the yarn core. To date, there has been no serious attempt by the Food and Drug Administration (FDA) or the U.S. Department of Agriculture (USDA) to eliminate the use of such materials as a yarn core, but the issue is volatile and will eventually need to be resolved. The resolution may not be one which industry finds acceptable or even practical.

Wire and fiberglass are known to provide additional cut resistance to composite yarns by microscopically altering the edge of the cutting surface. This is due to exceptional high density and abrasiveness, which dulls the edge of any cutting instrument or device that contacts the material. Wire and fiberglass also add strength to a yarn. The materials are preferred because of the many benefits they add to a composite relative to the cost. However, these same materials are controversial because they cannot be allowed to escape from the composite yarn into the work place for environmental and/or health reasons. The present invention provides a composite yarn and fabric which may selectively incorporate wire and/or fiberglass and/or other necessary but potentially harmful materials into the basic yarn core, but which offers protection to the worker from exposure to the materials, which materials may fragment or splinter and threaten the health of the worker and also damage the end product.

The present invention provides a novel method of forming a containment barrier around a single component or multi-component core of such controversial and potentially contaminating materials, and substantially decreases the risk of these contaminates being released. The foundation of the present invention is a composite yarn which uses melt-fusible thermoplastics or liquid adhesive coatings to encapsulate and thereby isolate one or more core materials which may present a threat of contamination to workers or the environment. This novel yarn is basically comprised of one or more core materials which are covered in thermoplastics or liquid adhesives and additional layers of material which form one or more outer layers. The combination is then heat-set or otherwise cured to form a flexible fiber barrier which surrounds and entraps the unsafe core.

In a first method of manufacture, the barrier which contains the selected core is created by melt fusing a thermoplastic material with other differing fiber products in such a way that these undesirable materials are trapped between a shroud of fused fibers and a fiber core. In other embodiments, materials which are longitudinally positioned to form the core are encapsulated in a continuous fibrous sheath with no adhesion between the sheath and an inner core yarn.

It is preferred to trap wire in a fused-fiber layer having a smooth outer surface which is unlikely to bond with subsequent outer cover layers. Because wire itself has a smooth surface unlikely to bond with thermoplastic, it is important that the core bond to the thermoplastic and isolate the wire therebetween. The combination becomes a highly effective containment vehicle that retains a high level of flexibility. While the end product, such as a glove, may become slightly more rigid after heat-treating to retain shape, the composite yarn is highly flexible and can therefore be easily knitted, woven, braided, or otherwise formed into a glove or other product. There are many different materials and processing methods available to form the composite yarn, depending on the end use desired. Conventional covering or wire-wrapping equipment is most suitable to manufacture this form of the composite yarn. Other equipment may be used as needed to preprocess materials that can later be wrapped or used as wraps. Examples are commingling machines, twisting equipment, and extruding machines.

It has also been discovered that a new group of adhesive coatings can be utilized and do not require the application of heat to fuse the containment fibers together. Most of these adhesive coatings are liquid at room temperature, enabling a method which allows greater freedom in yarn design by eliminating the effect that high temperature curing can have on fibers. With the exception of those compounds, which become thermoplastic when cured, these adhesives are thermostable and normally will not return to their original state. Therefore it is possible to manufacture yarns containing adhesives with cured melting temperatures higher than the associated fibers.

The group of useful adhesives includes, but is not limited to polyurethanes, silicone, natural or synthetic rubber, polysulfide systems, epoxy-polysulfides, vinylidene chloride and blended polymers derived from this group. The novel method eliminates the necessity for in-line curing ovens because curing occurs within the protective outer sheath. As will be described in more detail in the following material, coatings can be applied, covered, and the yarn taken up on the finished yarn package in a space of approximately sixty inches, with the yarn being processed at speeds of 150 feet per minute or more.

Methods of application will vary somewhat depending on the materials being processed, the volume of adhesive being required, and the characteristics desired for the finished product. These methods are more fully described below.

In either method of manufacture, the basic core of the composite yarn is selected from a group of fibers or types of other materials, which may be spun, continuous, multifilament, or monofilament. The basic core is selectively comprised of a single strand or multiple strands of single fiber type or a mixture of fiber types. The core structure is virtually unlimited and may include fiberglass, wire strands, thermoplastics, and/or other such controversial materials or combinations of such materials. The core structure may be of a plurality of such fibers combined by blend spinning, twisting, extrusion or any other method deemed appropriate to accomplish the desired core and end product.

Several previously unknown benefits of yarns manufactured in accordance with these methods have been discovered. It has been found that abrasives such as wire or fiberglass perform their function better when locked firmly in place. The function of abrasives in cut resistant yarns has been explained as dulling the cutting edge and thereby increasing the performance of the other high strength fibers. When wire is used, it tends to move away from the cutting edge exposing more fiber to the threat. When wire is fused in place as with the present invention, it engages the edge more directly and is more abrasive. It effectively shields subsequent layers until the full abrasive effect is used. This is also true with fiberglass. Fiberglass is not effective once it is fragmented and this occurs quickly upon contact with the cutting edge and during normal flexure. By bonding the glass with the methods described, it is less easily shattered. The maximum abrasive ability is obtained by presenting the glass as a unified and unmoving abrasive surface that is not easily shattered. By making these abrasives more effective, it is now possible to attain equal cut protection with a lower abrasive content or to increase protection with equal contents.

When the cutting threat is from a chopping blow as opposed to a slashing movement, the present invention also exhibits unique abilities. The fused fibers of the invention are pulled in the direction of the cutting edge thus increasing the concentration of protective fiber and abrasives in the threat area. This increases the level of protection to this type of threat.

It has also been found that this method of manufacturing creates a yarn with improved abilities to absorb impacts and vibration of all types. This is due to the resilient properties present in the compounds used for fusing the composite together. This characteristic is useful to dampen vibration and provide a measure of protection from blunt trauma.

The core containment barrier has been found more useful in containing wire than originally believed. It was believed that longitudinally positioned strands of wire should not exceed 0.002 inch diameter due to an increased likelihood of puncturing the core containment barrier. Success was found with longitudinal wire strands of 0.006 inch diameter without increasing the overall diameter to the finished yarn. This allows the use of heavier wire strands with minimal risk of barrier puncture.

Finally, it has been observed that embodiments having cores formed largely of melt fusible thermoplastics become hollow after heat treatment. These embodiments are very unique and exhibit improved ductility. This is important in apparel applications where wearer comfort is important.

In some embodiments, rather than bond the core directly to the thermoplastic adhesive, it is desirable that the selected core is next covered with a layer of material which creates an inner core containment barrier separating the core from the surrounding melt-fusible thermoplastics. This is necessary to prevent the core structure from bonding with the thermoplastics and thereby restricting flexibility. Core materials that are particularly brittle will deteriorate quickly if not allowed to move freely within such a shroud. This inner core containment barrier may be of any material that has a higher melt point than the thermoplastics that surround it.

Using the heat-set method rather than liquid internal coating, a preferred embodiment includes a basic core, and around the circumference of the basic core, the first layer of one or more strands of wire may be wrapped to provide a second component to the core. The wire may be wrapped in one direction with one or more strands applied parallel to each other, or the wire may be twisted or combined in any other known way. The wire may also be wrapped in opposing directions relative to each other, with one strand being clockwise, and the other counterclockwise. The preferred wire is an annealed stainless steel 304 with a range of 0.008 inch diameter or smaller. The most preferred is 0.0045 inch for a single wrap, or 0.003 inch for a double wrap. Finer strands may be used when there is a combined plurality of wire strands. In such embodiments, using wire of 0.002 inch diameter or more, wrapping is preferred. The wire wrapped about the basic core may be wrapped at a pitch of 1 to 100 turns per inch, as the embodiment requires. It has been observed that the helical shape that is thus formed directs the wire's angle more to the center of the composite yarn structure. This becomes important when a wire strand fractures. Longitudinally positioned wire strands tend to project a rigid point when broken. This rigid point is then so oriented as to puncture the surface when the yarn is flexed and is difficult to contain.

Following application of the wire component to the basic core and/or the inner core containment barrier, an adhesive layer to be added to the composite yarn is selected from the group of melt-fusible thermoplastics. These may be polypropylene; low, high, or ultra-high-density polyethylene; low-melt nylon polyamid; or polyamid blends; or low-melt polyesters. A number of higher melt temperature thermoplastics exist which have not been tested, but are believed to be applicable for higher temperature applications and embodiments. This layer adhesive may be applied in several different ways, including wrapping, twisting or spinning about the core and the inner core containment barrier; may be longitudinally positioned with the core, extruded over the core, blended with the core, commingled with the core, or any combination of these methods. The thermoplastics also may be applied to the wire strands prior to wrapping the strands around the basic core. The selected method of combining the thermoplastics with the wire is dependent upon the number and size of the wire strands being utilized. The wire strands may be wrapped, twisted, paralleled, paralleled and wrapped with more thermoplastic, paralleled and wrapped with very fine denier non-thermoplastic, or the wire may be coated by means of any of the more conventional coating methods.

Selected thermoplastics for this layer may be monofilament, multifilament, spun or blended with other materials. The percentage of thermoplastic content in this layer is limited only to that which is necessary to properly contain and stabilize the underlying materials. When combining with the wire prior to wrapping the wire around the basic core member, two benefits are attained. First, prior combining allows a step to be eliminated in processing by not requiring a separate wrapping of thermoplastic. Secondly, the thermoplastic is concentrated only in the area that surrounds the wire, leaving some unfused areas to increase the flexibility of the composite. Some of the more effective methods will be detailed below.

The next layer is the primary core containment barrier and is selected from a broad group of synthetic or organic materials including but not limited to: polyester, nylon, aramid, high density polyethylene, ultra high molecular weight extended chain polyethylene, such as Allied Signal's SPECTRA, cotton, wool, polycotton, rayon, Hoechst Celanese's PBI, Dupont's TEFLON and blends thereof. The exceptions are those materials which are the same as those to be contained, and materials having melt points which are lower than the selected thermoplastic. This layer serves several functions:

1) It forms the layer of fiber that is fused with the underlying adhesive layer to form a shroud. In certain embodiments wrapped wire is the material to be contained and this layer is utilized to fuse with the material of the basic core around which the wire is wrapped. This results in a sandwich effect that thoroughly traps the wire in a flexible capsule or fused fibrous material that is almost impenetrable.
2) In embodiments using wrapped wire, this shroud functions to prevent the wire from moving as the composite is heated. The selected fiber must therefore be of reasonably high tenacity and not generally susceptible to loss of strength at the fusion temperature of the underlying thermoplastic.
3) This layer adds cut resistance to the finished composite yarn.
4) This layer serves as a shroud that has sufficient thickness to absorb the underlying melt-fusible polymer and prevent the polymer from passing to the outer wraps. This is of particular importance when subsequent outer covers must be able to function independently of the core and core containment barrier yarns. Independent movement is sometimes necessary primarily for flexibility, but also allows the performance characteristics of the yarn not to be impeded by entrapment. It has been observed that yarns are more cut and/or abrasion resistant when the yarns are allowed to move freely with the cutting or abrading surface. This is simply illustrated by observing the relative ease with which a yarn may be cut under tension, versus one that is cut under less tension.

In addition to the above functions, when used in the wrapped wire embodiments, it is preferred that this third layer be wrapped at the number of turns per inch which provides an angle as close to 90 degrees relative to the wire as feasible. Near perpendicular angles are optimal to allow the finished composite yarn to perform. Present embodiments have attained a 70 degree angle at 8 turns per inch using 840 denier nylon. In other embodiments it is necessary to apply a lighter denier at a very high range of turns per inch. This is particularly true where multiple ends of wire are wrapped in opposing directions. The turns per inch must be a combination of optimal angles, total encapsulation, density of the layer and the fiber's ability to prevent movement of the wire during the heat cycle. It should be noted that the type 304 alloy of stainless steel has a coefficient of thermal expansion equal to $10.1\times10^{-6}$ per degree rise in temperature Fahrenheit. If the composite is processed at 295 degrees Fahrenheit then a one-inch section would normally expand to 1.00226846 inch. While this amount of movement may appear small, it does have the ability to deform the fabric if not controlled. Testing has shown that wire can push through the thermoplastic layer as the wire expands during the heat cycle, and this movement prevents a proper bond from forming because the thermoplastics tend to cool more quickly than wire. This layer ideally should be wrapped with a comparable range of turns per inch as the underlying core using a yarn of sufficient weight or diameter to provide complete coverage and density. However, yarns from 20 to 4800 denier may be used and may be applied from 3 to 200 turns per inch as the embodiment requires. This shroud layer may be one or more wraps in similar or opposing directions relative to one another. As with the basic core, this layer can be made up of a multiplicity of yarns, depending on the desired end effect or product.

In the preferred embodiments described below, it will be obvious that the simpler methods and yarn combinations achieve the best results.

A final, or outer, layer may also be added. This outer layer is of particular importance when the underlying layer is not capable of absorbing the molten thermoplastic and preventing it from rising to the surface of the finish product (known as "wet out"). The fiber content of this outer layer may be selected from the same group as the wire-containment barrier. There may be one or more of these outer layers and each may be similar or dissimilar. The selected material wrap may be of a single strand, multiple strands of a single yarn or a multiplicity of differing yarn fibers or types. This outer layer may also be spun over the underlying layers as with friction spinning equipment.

With use of such overlying multiple layers it is preferred, but not required, that each of the layers be wrapped in opposing directions. This method of wrapping in opposing directions is known as counterbalancing and has the effect of making the yarn balanced, straight, and with separate covering layers that tend to lock together and do not easily fray.

The combined selection of yarn fibers and types is based primarily on the end use of the yarn, the fabric or the product. Some of the more common materials are nylon, polyester, aramid, extended chain polyethylene, rayon, cotton or wool. However, the fibers/types may be selected from any of the synthetic or natural materials group. Any one of the layers or wraps may serve any of the functions of enhanced cut resistance, abrasion resistance, improved comfort to the wearer, increased thermal performance, enhanced texture for handling special materials, improved knitability, or other such characteristics.

When utilizing the liquid adhesive method of manufacture, the liquid coatings are applied to one or more of the aforedescribed core materials, prior to application of the other layer(s). This is done by drawing the selected core member through a trough mounted near the entry point of the covering mechanism. The volume of adhesive applied is controlled by dilution of the fluid, by varying the number of core yarns coated, and by altering the core's dwell time in the trough with repeated loops over a submerged feed wheel.

Following this liquid application the core member enters directly into the covering spindle(s) or spinning head and is covered with one or more fibers which absorb the excess adhesive and form the aforedescribed containment barrier. Sufficient fibers should be applied to prevent any possible fluid migration to the outer surface of the yarn. By absorbing the excess adhesive and eliminating possible migration to the outer surface of the yarn, the finished yarn can be immediately wound onto a package, before the liquid adhesive is cured. It has been proven that the volume of liquid adhesive which is applied to the core can be controlled and that a finished yarn can be accomplished with sufficient adhesive to migrate close to the yarn surface, thereby affecting texture and appearance, but without bonding the yarn to the package.

Such an application has been found beneficial in modifying yarns which have an unacceptable hand or color, but which otherwise demonstrate desirable characteristics. One example of such a yarn, manufactured by Allied Signal and sold under the trademark SPECTRA, demonstrates superior strength but is too slippery or slick for use in articles such as gloves.

It has also been discovered that with this liquid internal coating process, beneficial additives may be put into the core of the yarn. One such additive is grit which can be mixed with the liquid adhesive in sufficient volume to act as an abrasive which has the affect of dulling a cutting edge, therefore aiding in the cut resistance of the finished product. Grit of a sufficient size is also effective in inhibiting or preventing puncture by surgical needles by dulling the point of the needle, and by blocking the hollow channel of the needle. By blocking this channel, the surface area of the needle is increased and further penetration is substantially inhibited.

The finished novel composite yarn is applicable to knitting, weaving, braiding, twisting, or otherwise forming into a desired fabric or product. Once the end product is provided, the final step of thermoplastic fusion generally takes place. Treatment temperatures and exposure times will vary according to the characteristics of the thermoplastic, density of the composite and thickness of the article manufactured. With gloves, for example, a typical heat treating method would make use of a glove dotting machine which is designed for precise temperature and exposure time control. Yarns may also be heat treated on the package in a dry or wet yarn-conditioning oven.

DETAILED DESCRIPTION OF THE PREFERRED EMBODIMENTS

These definitions will be helpful in identifying the various designations and functions of the described layers.

(1) Basic Core: May be one or more longitudinal materials including all thermoplastic fibers, and carbon fibers or other possible contaminate groups. Basic core may have these selected materials spun, wrapped, twisted or coated by application of liquid adhesive over one or more longitudinal members.

(2) Inner Core Containment Barrier: This is an optional layer for use in those embodiments that require separation of the core and adhesive layers. It may be spun or wrapped over the core. Selected materials only exclude those contaminates of the basic core or materials with melt temperatures equal to or lower than the thermoplastics of the heat processed embodiments.

(3) Adhesive layer: This layer may be used as the only source of adhesives, in conjunction with adhesives in the basic core, or not used at all when sufficient adhesion is available from materials in the basic core. The layer may be wrapped, spun, coated by application of liquid adhesive, twisted or positioned longitudinally to the basic core or inner core containment barrier layers.

(4) Primary Core Containment Barrier: From the same group of materials selected for the inner core containment barrier; may be wrapped or spun over the inner layers and be singular or a plurality of yarns combined in any way.

(5) Outer Layer(s): From the same group of containment barrier fibers; this layer or layers are optional to enhance performance as needed.

Figure 1A:
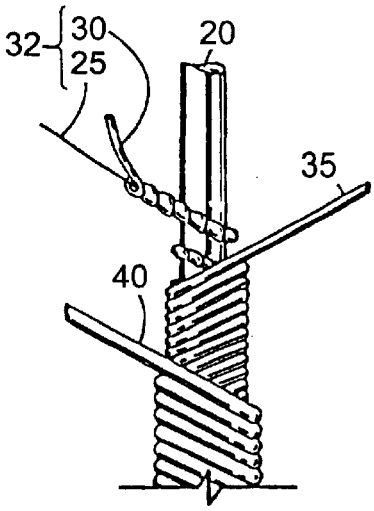
FIGS. 1A, 1B, 2A, 2B and 2C, 3, 4, 5, 7 and 8 are schematic representations of various embodiments of the composite yarn.

Looking first at FIG. 1A, a first embodiment is detailed as having a basic core 20 formed of 840 denier industrial grade nylon. A single wrap 25 of 0.0045 inch diameter annealed stainless wire is applied over core 20 at approximately 8 turns per inch of core length. Wrapped about this single wire wrap 25 is a low-melt-temperature thermoplastic adhesive layer 30 of a type such as 0.006 inch Shakespeare monofilament NX 1012 terpolyamide, thereby forming a wire/thermoplastic layer 32. The thermoplastic adhesive layer 30 is applied over wire 25 at approximately 10 turns per inch of wire core length. A primary core containment barrier 35 is applied in the opposite direction (relative to the wire/thermoplastic layer 32) and is preferably formed of 840 denier industrial grade nylon; again wrapped at approximately 8 turns per inch of core or yarn length. A final outer layer 40 is comprised of one strand, wrapped in a direction opposite to the underlying layer 35 at approximately 8 turns per inch of core or yarn, formed of 840 denier industrial grade nylon.

While this embodiment in FIG. 1A is one of the basic approaches, it combines the thermoplastic fiber with the wire wrap prior to wrapping the wire about the basic core. Thus, the adhesive action of the thermoplastic is concentrated in the critical areas. By wrapping the wire core with 840 denier nylon, the wire and nylon intersect at an optimal angle to contain the thermal expansion of the wire while still maintaining total coverage of the wire. Test results of this embodiment indicate that the composite yarn is equally cut-resistant to any other known wire/yarn products, and exhibits no detrimental rigidity resulting from the unique encapsulation of the wire.

Figure 1B:
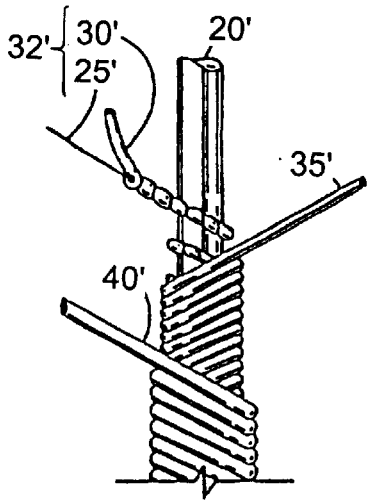

Using the same basic structure of layers shown in FIG. 1A, another embodiment shown in FIG. 1B features a basic core material 20' of 1200 denier extended chain polyethylene wrapped with a wire strand 25' of 0.0045 inch diameter annealed stainless steel at approximately 5 turns per inch. The 0.0045 inch diameter steel wire 25' is itself wrapped with conventional multifilament or monofilament polyethylene 30' of approximately 200 denier before the wire is wrapped around the basic core 20'. A subsequent wrap 35' is, in this embodiment, formed of 650 denier extended chain polyethylene at a range of 5 to 6 wraps or turns per inch to completely cover the wire/thermoplastic layer 32'. The final outer wrapping 40' is formed of 840 denier industrial grade nylon wrapped at approximately 8 turns per inch of core or yarn.

It should be noted that this second basic embodiment described with reference to the layered structure of FIG. 1B utilizes an extended chain polyethylene having a melt point of approximately 297 degrees Fahrenheit to form layer 35' to wrap or cover the wire strand 25' which has been previously wrapped with a conventional polyethylene 30' having a melt point of approximately 200 degrees Fahrenheit, thereby ensuring formation of an adhesive bond between the encapsulating primary core containment barrier 35' and the core. Such a structure is preferred because the conventional polyethylene helps compensate for the poor adhesive performance of extended chain polyethylene. This structure also offers an exceptionally high level of cut resistance and an equally good ability to encapsulate the wire because of extended chain polyethylene's unsurpassed strength and cut resistance. Nylon is used as the outer wrap 40' because of its dissimilarity from the core. If the heat application is not precisely controlled the extended chain polyethylene material can reach the softening point and bond with the outer covers, thus increasing the likelihood of rigidity in the end product.

Figure 2A:
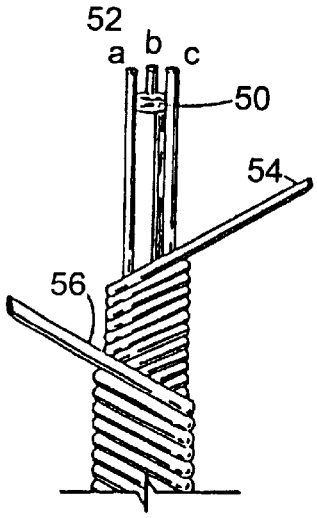
Figure 2B:
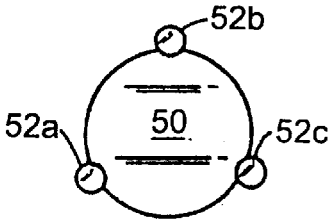
Figure 2C:
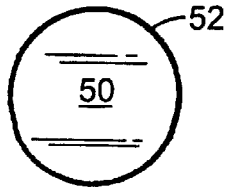

Looking next at FIG. 2A, and cross-sectional views 2B and 2C, a third embodiment has a core 50 formed of a single strand of 900 denier fiberglass. Positioned longitudinally of this core 50 is an adhesive layer 52 of three spaced apart strands of 0.006 inch Shakespeare NX 1012, strands 52*a*, 52*b*, and 52*c* having a melt point of 275 degrees Fahrenheit. A single encapsulation shroud or core containment barrier 54 is formed of 840 denier high tenacity nylon wrapped over the underlying materials at approximately 8 turns per inch of core or yarn length. A subsequent outer cover 56 is formed of the same 840 denier nylon wrapped in the opposite direction (relative to 54) at approximately 8 turns per inch. In this example the terpolyamide (melt fusible nylon) does not completely contain the core prior to application of heat. However, during the heat cycle the composite has a sufficient quantity of this melt fusible material to flow around the entire circumference of the core (FIG. 2C). Because the 840 denier nylon core containment barrier 54 is a polyamide, an excellent bond is formed with the melt fusible terpolyamide 52*a*, 52*b* and 52*c*. Residual polymer will adhere to the fiberglass core. The outer wrap 56 is not fused to the core containment barrier 54 because there are sufficient layers of the inner wrap to absorb the melt fusible material.

Figure 3:
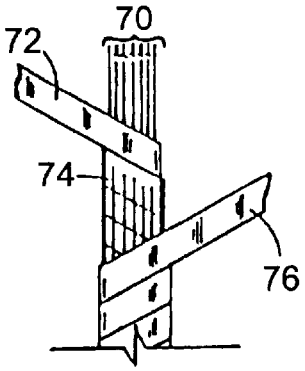

FIG. 3 illustrates a fourth embodiment which utilizes 14 strands of 35 micron type 304 stainless steel to form a longitudinally oriented core 70. The core 70 is wrapped with 650 denier extended chain polyethylene at 5 turns per inch to form an inner core containment barrier 72. Then multiple strands of 0.005 inch low density polyethylene monofilament are added to longitudinally surround the wrapped core parallel to the 14 strands of stainless steel which form core 70, thus forming adhesive layer 74. A final outer layer of 200 denier TFE fluorocarbon (such as that made by Dupont Corporation and sold under the trademark TEFLON) is wrapped in the opposite direction (relative to wrap 72) at approximately 12 turns per inch to form the outer cover or primary core containment barrier 76. In this example, unusually fine strands of wire are used to create a highly flexible core 70 which has a resulting denier equivalent to 1000; yet each of the individual strands is unable to puncture the relatively fine inner core containment barrier layer 72. The extended chain polyethylene that forms the inner core containment barrier 72 is preferably made by Allied Signal and sold under the trademark SPECTRA.

This FIG. 3 embodiment is somewhat unique when compared to the other embodiments taught herein in that the outer cover or primary core containment barrier 76 is in direct contact with the adhesive layer 74 and is therefore fused to the other materials. It has been found that due to the lubricity of TEFLON, the layer 76 must be fused in order to prevent the TEFLON layer from moving and exposing the materials beneath. Furthermore, TEFLON does not need to function independently in order to adequately perform in this embodiment. The unusually heavy layer prevents the thermoplastic adhesive layer 74 from flowing to the surface. This embodiment is particularly suited to the production of a cut-resistant surgeon's glove that is worn so as to underlie the conventional sterile latex glove used in most surgical facilities.

Figure 4:
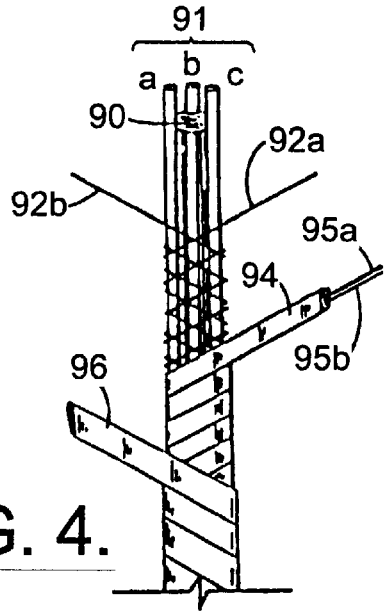

FIG. 4 illustrates a fifth embodiment wherein a basic core 90 is formed of 1000 denier KEVLAR 29 (aramid) made by Dupont Corporation. This basic core 90 is contained by a primary core containment barrier 94 formed of approximately 1000 denier polyester incorporated with two parallel strands 95*a* and 95*b* of 160 denier polyethylene. This layer 94 is wrapped at approximately 5 turns per inch in the opposite direction to the wrap of the outer core wire strand 92*b*. A final outer layer 96 is formed of the same polyester and is wrapped at approximately 5 turns per inch in a direction opposite that of the primary core containment barrier 94. This composite yarn is suitable for production of gloves that are knitted and then heat treated for approximately 5 minutes at 340 degrees Fahrenheit in a conventional glove-dotting machine.

In this embodiment of FIG. 4, the adhesive layers 91*a*, 91*b* and 91*c* are positioned beneath the core wire strands 92*a* and 92*b* longitudinally to the basic core 90. Additional thermoplastic is commingled with the primary core containment barrier 94 for ease of processing. Because two core wire strands 92*a* and 92*b* are used in opposing directions, the primary core containment 20 barrier 94 is applied radially outwardly of the outer wire strand 92*b*. Since the first, or inner, wire strand 92*a* is wrapped with the same number of turns and in the same direction as the primary core containment barrier 94, it would normally push through the commonly oriented filaments of polyester during the heat cycle. By wrapping opposite the outer wire strand 92*b*, and thereby controlling its expansion, expansion of the inner wire strand 92*a* is thus also controlled. Polyester is useful as an encapsulating shroud and as an outer layer due to its shrinkage of approximately 14 percent of the heat-set temperature of 340 degrees Fahrenheit. Shrinkage causes the polyester to contract against the expanding wire and form more closely with the core material, establishing a strong adhesive bond.

Figure 5:
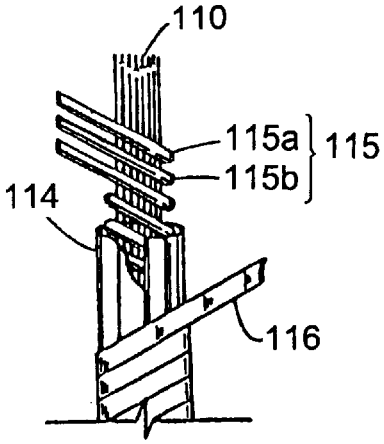

The embodiment of FIG. 5 demonstrates there are a variety of yarn constructions that fall within the teachings of this disclosure and claims and can be used to create the same or similar products. This embodiment is comprised of a core 110 formed of approximately 14 strands of 35 micron type 304 stainless steel wire such as that manufactured by Beckert Company. Wrapped about this core 110 is an inner core containment barrier/adhesive layer 115 formed by combining a wrapping 115*a* of 200 denier industrial grade multifilament nylon, wrapped at approximately 30 turns per inch of core length, with a parallel strand 115*b* of 0.006 inch melt fusible terpolyamide monofilament. The preferred terpolyamide monofilament is Shakespeare NX 1012, which has a melt point of 275 degrees Fahrenheit. Positioned parallel to the core 110 and overlying layer 115 is a single strand 114 of 1200 denier TFE fluorocarbon, such as TEFLON. The TEFLON is carefully fed through a device that first flares the width of the multifilament, then tapers around the core 110 so as to surround the inner surface of the core 110 and layer 115 with TEFLON filaments. A final outer layer 116 of 200 denier nylon is wrapped at a range of 5 to 8 turns per inch in the opposite direction relative to the layer 115. This outer layer 116 holds the TEFLON in place until the composite yarn is heat-treated.

Figure 7:
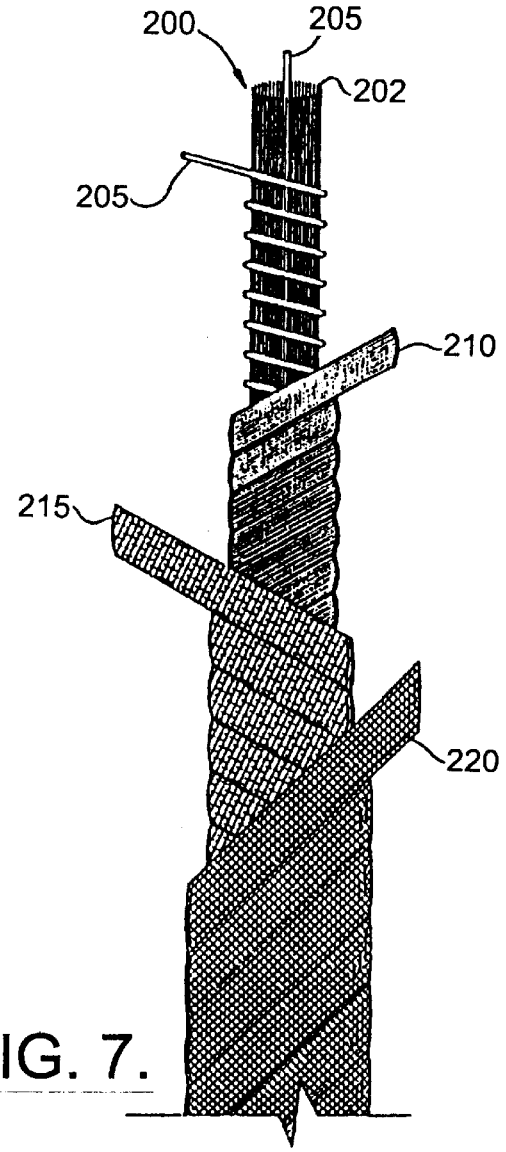

FIG. 7 illustrates a yarn construction wherein the core 200 is formed of an industrial grade polyester (500 denier) 202 combined with a single longitudinal strand of 0.003 inch type 304 stainless steel wire 205 and wrapped with a single strand of 0.003 inch type 304 stainless steel wire 205. The adhesive layer 210 is helically wrapped about the core 200 at approximately 7 turns per inch, preferably formed of 350 denier, 70 filament, low density polyethylene. Over this adhesive layer is a primary core containment barrier 215 formed of 500 denier industrial grade polyester which is helically wrapped opposite to the adhesive layer at approximately 9 turns per inch. A final outer layer 220 of 1000 denier industrial grade polyester is wrapped opposite to the primary core containment barrier 215 at a pitch of approximately 8 turns per inch. The finished yarn is then heat set for approximately two and one-half to two and three-quarter hours, at 280 degrees Fahrenheit in a steam conditioning unit. The yarn of this embodiment is highly suited for the construction of industrial gloves and other cut-resistant fabrics.

Figure 8:
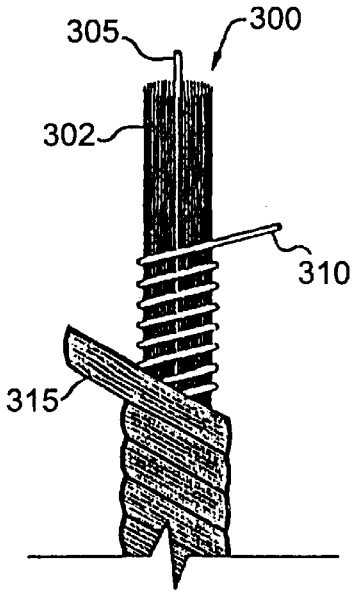

FIG. 8 illustrates a core 300 of 150 denier textile grade polyester 302 combined with 100 denier, 70 filament low-density polyethylene 305. Wrapped about this basic core is a single strand 310 of 0.002 inch type 304 stainless steel wire that is wrapped at a pitch of 24 turns per inch. The primary core containment barrier 315 (the final layer) is 300 denier textile grade polyester wrapped in a direction opposite to that of the wire at a pitch of approximately 10 turns per inch. The finished yarn is then heat set for one and three-quarter hours at 280 degrees Fahrenheit in a steam conditioning unit. This embodiment is best suited for finer cut-resistant fabrics, and most particularly, for cut-resistant surgical gloves.

Figure 9:
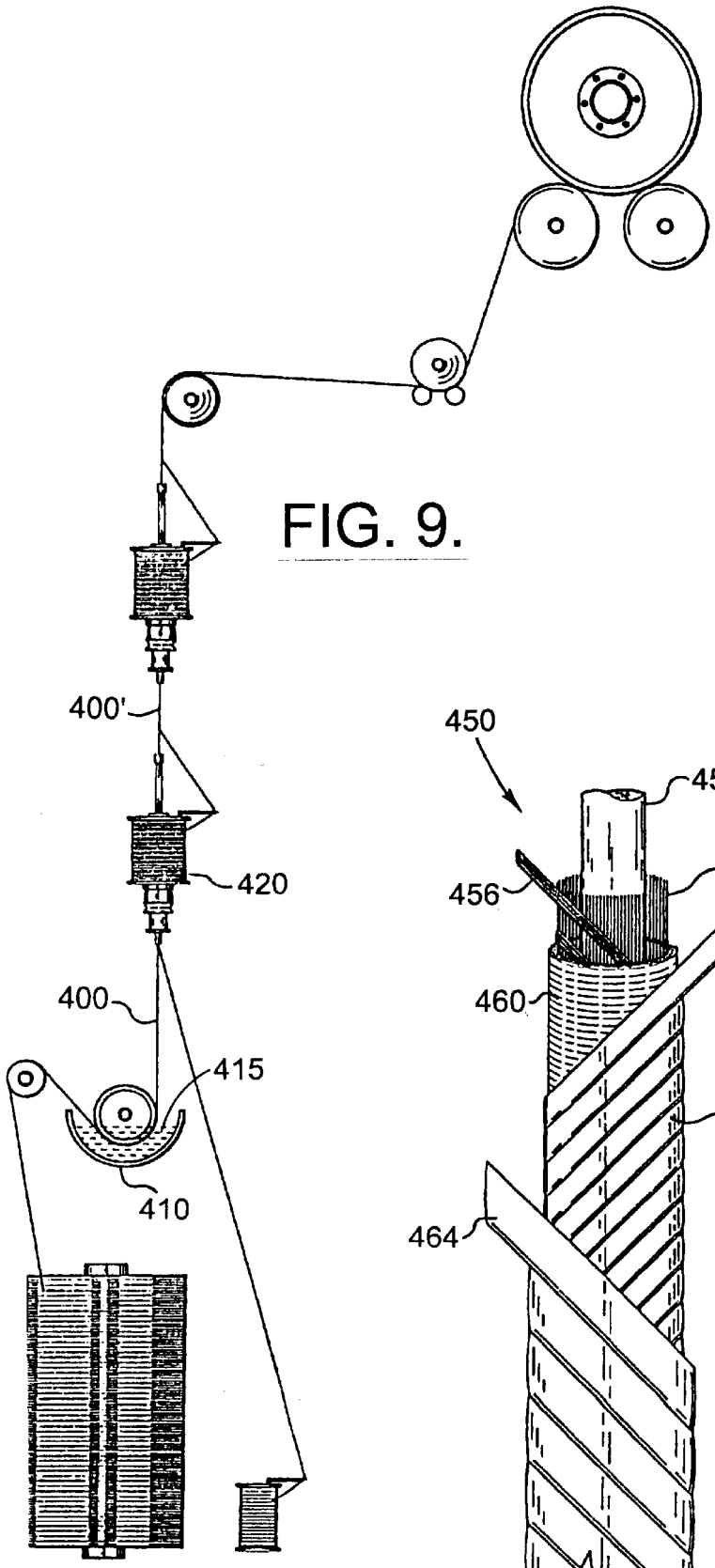
FIG. 9 is a schematic representation of the manufacturing process of liquid adhesive application.

FIG. 9 illustrates the progressive movement of a core member 400, formed of selected desired components, as it is drawn by known coating apparatus through a trough 410 which has a selected liquid-form adhesive therein. As previously described, the liquid adhesive 415 may be any of the polyurethanes, silicone, natural or synthetic rubber, polysulfide systems, epoxy-polysulfide, vinylidene chloride, or blended polymers derived from these. Others may also be suitable. As the coated core member 400 leaves the trough 410, it moves directly into a covering spindle or spindle head 420 where it is covered with a selected fiber, or fibers, which when combined with the liquid adhesive coating form the aforedescribed core containment barrier. The fiber covered core 400' is then wound onto a yarn package or moved forward to additional covering stations.

Figure 10:
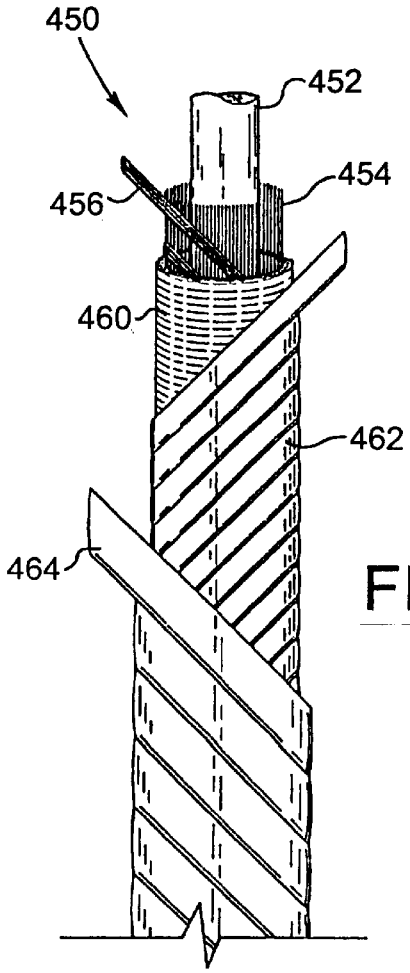
FIGS. 10, 11 and 12 are schematic representations of embodiments wherein the yarn is manufactured according to the liquid adhesive application method.

FIG. 10 illustrates a preferred embodiment of the finished yarn 450 wherein a basic core 454 of 650 denier SPECTRA is combined with a longitudinally positioned 0.0045 inch stainless steel wire strand 452. A single strand 456 of 0.003 inch stainless steel wire is wrapped over the basic core 454 at approximately 8 turns per inch. In a separate step, the core is coated and covered with a selected liquid adhesive 460; preferably polyester-based polyurethane containing 2 percent isocyanate crosslinker. One such crosslinker is designated UE-41-347 and supplied by Permuthane Coatings Company.

After the coating 460 is applied, the coated core receives a primary core containment barrier 462 and an outer layer 464 of 650 denier SPECTRA. The primary core containment barrier 462 is wrapped opposite to the wire strand 456 of the core, and both SPECTRA layers 462 and 464 are wrapped at approximately 9 turns per inch opposite to each other. The resulting yarn contains approximately 11 percent cured polyurethane and is suitable for cut-resistant gloves, sleeves and aprons.

Figure 11:
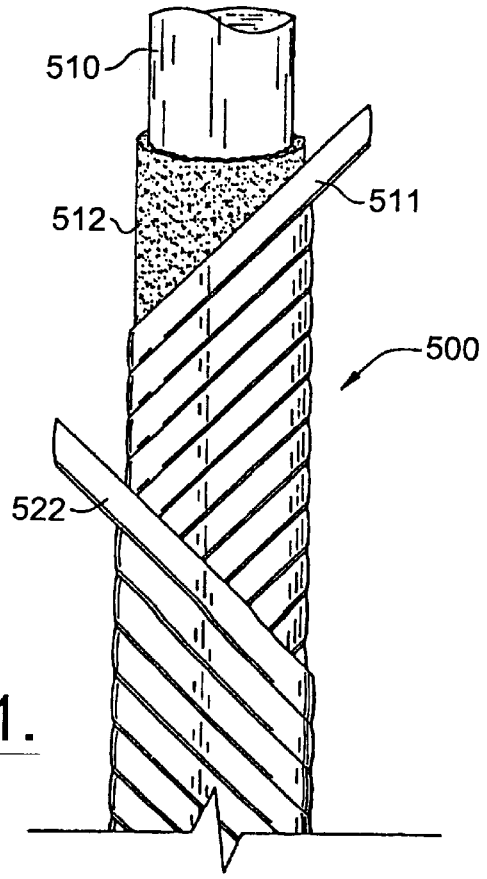

FIG. 11 illustrates an embodiment wherein yarn 500 is formed by first coating a core 510 of 650 denier SPECTRA with a solution of polyester-based polyurethane and 2 percent isocyanate crosslinker which contains 30 percent by volume of a silicon grit to form a liquid adhesive coating 512. The preferred grit is a blend containing 40 percent of particle size 80 grit and 60 percent size 120 grit. The coated core then passes into the covering spindle (reference numeral 420 of FIG. 9) where a primary core containment barrier 511 and an outer layer 522 of 650 denier SPECTRA are applied, opposite to each other, at approximately 10 turns per inch. This finished yarn 500 contains 16 percent set polyurethane and 9 percent silicon carbide grit by weight. The grit is trapped in the adhesive bond that exists between the core and the outer fiber layers. This embodiment demonstrates enhanced cut resistance and additional puncture resistance. It is suited for industrial applications where such threats are a concern.

Figure 12:
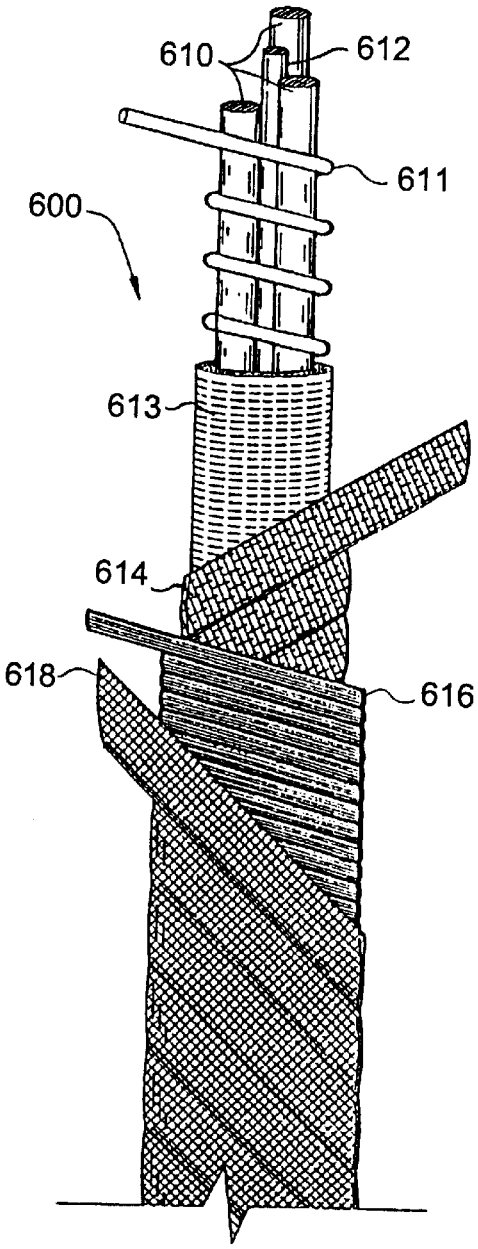

FIG. 12 illustrates another preferred embodiment wherein a yarn 600 is formed having a basic core of three strands 610 of 8.75 inch low density polyethylene monofilament combined with a parallel strand 612 of 0.0045 inch type 304 stainless steel wire. These core members are then wrapped with a strand of 0.003 inch type 304 stainless wire 611 at a pitch of approximately 10 turns per inch to complete the core. As in the embodiment of FIG. 10, the completed core is then coated with a solution of polyester-based polyurethane containing 2 percent isocyanate crosslinker to form a liquid adhesive coating 613. The next layer, primary core containment barrier 614, is 840 denier nylon wrapped opposite to wire strand 611 at 8 turns per inch. A first outer layer 616 of low-density polyethylene is wrapped opposite to the underlying primary core containment barrier 614 at a pitch of approximately 10 turns per inch. A final outer layer 618 of 840 denier nylon is then wrapped opposite to outer layer 616 at 8 turns per inch. The packaged yarn is heat treated with steam at 275 degrees Fahrenheit for approximately three hours. The resulting yarn possesses a core that is hollow except for the wire strands 612 and 611. The yarn 600 is highly cut resistant, exceptionally ductile and suited for knitting or weaving.

Figure 6:
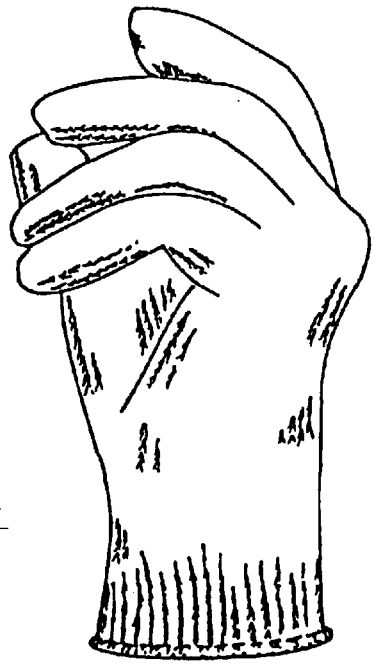
FIG. 6 is a perspective view of a glove made from the composite yarn.

Finally, FIG. 6 illustrates a cut-resistant glove made from any one of the embodiments of the composite yarn described herein. The glove demonstrates improved cut resistance, flexibility and comfort. Other end products are anticipated to be made from the novel yarn described herein, other embodiments of the yarn are anticipated, and all are believed to be within the scope of the claims below.

That which is claimed is:

1. A composite yarn comprising a core comprising a longitudinal synthetic fiber strand and a wire strand wrapped about said at least one synthetic fiber strand;

an adhesive layer comprising a thermoplastic fiber strand wrapped about said wire strand of said core;

a primary core containment barrier positioned radially outwardly of said adhesive layer and comprising a synthetic fiber strand wrapped about said wire strand of said core and said adhesive layer in a direction opposite to the direction of said wire strand of said core; and an outer layer positioned radially outwardly of said primary core containment barrier and comprising a synthetic fiber strand wrapped about said primary core containment barrier in a direction opposite to the direction of said synthetic fiber strand of said primary core containment barrier.

2. The composite yarn of claim 1 wherein said synthetic fiber strand of said core is nylon and said wire strand of said core is stainless steel;

said thermoplastic fiber strand of said adhesive layer is terpolyamide;

said synthetic fiber strand of said primary core containment barrier is nylon; and said synthetic fiber strand of said outer layer is nylon.

3. The composite yarn of claim 2 wherein said nylon fiber strand of said core has a denier of about 840 and said stainless steel wire strand of said core has a diameter of about 0.0045 inches and is wrapped about said nylon fiber strand at about 8 turns per inch;

said terpolyamide fiber strand of said adhesive layer is wrapped about said stainless steel wire strand of said core at about 10 turns per inch;

said nylon fiber strand of said primary core containment barrier has a denier of about 840 and is wrapped about said wire strand of said core and said adhesive layer at about 8 turns per inch; and said nylon fiber strand of said outer layer has a denier of about 840 and is wrapped about said primary core containment barrier at about 8 turns per inch.

4. The composite yarn of claim 1 wherein said synthetic fiber strand of said core is extended chain polyethylene and said wire strand of said core is stainless steel;

said thermoplastic fiber strand of said adhesive layer is polyethylene;

said synthetic fiber strand of said primary core containment barrier is extended chain polyethylene; and said synthetic fiber strand of said outer layer is nylon.

5. The composite yarn of claim 4 wherein said extended chain polyethylene fiber strand of said core has a denier of about 1200 and said stainless steel wire strand of said core has a diameter of about 0.0045 inches and is wrapped about said nylon fiber strand at about 5 turns per inch;

said polyethylene fiber strand of said adhesive layer has a denier of about 200 and is wrapped about said stainless steel wire strand of said core at about 10 turns per inch;

said extended chain polyethylene fiber strand of said primary core containment barrier has a denier of about 650 and is wrapped about said wire strand of said core and said adhesive layer at about 5 turns per inch; and said nylon fiber strand of said outer layer has a denier of about 840 and is wrapped about said primary core containment barrier at about 8 turns per inch.

6. A composite yarn comprising a core comprising a plurality of longitudinal wire strands;

an inner core containment barrier positioned radially outwardly of said core and comprising a synthetic fiber strand wrapped about said core;

an adhesive layer positioned radially outwardly of said core and comprising a thermoplastic fiber strand wrapped about said core in a direction parallel to the direction of said synthetic fiber strand of said inner core containment barrier;

a primary core containment barrier positioned radially outwardly of said inner core containment barrier and said adhesive layer and comprising a longitudinal synthetic fiber strand; and an outer layer positioned radially outwardly of said primary core containment barrier and comprising a synthetic fiber strand wrapped about said primary core containment barrier in a direction opposite to the direction of said synthetic fiber strand of said inner core containment barrier and said thermoplastic fiber strand of said adhesive layer.

7. The composite yarn of claim 6 wherein each of said plurality of wire strands of said core is stainless steel;

said synthetic fiber strand of said inner core containment barrier is nylon;

said thermoplastic fiber strand of said adhesive layer is terpolyamide;

said synthetic fiber strand of said primary core containment barrier is TFE fluorocarbon; and said synthetic fiber strand of said outer layer is nylon.

8. The composite yarn of claim 7 wherein each of said plurality of stainless steel wire strands of said core has a diameter of about 35 microns;

said nylon fiber strand of said inner core containment barrier has a denier of about 200 and is wrapped about said core at about 30 turns per inch;

said terpolyamide fiber strand of said adhesive layer is wrapped about said core at about 30 turns per inch;

said TFE fluorocarbon fiber strand of said primary core containment barrier has a denier of about 1200; and said nylon fiber strand of said outer layer has a denier of about 200 and is wrapped about said primary core containment barrier at about 8 turns per inch.

9. A composite yarn comprising a core comprising a longitudinal synthetic fiber strand, a longitudinal wire strand and a wire strand wrapped about said synthetic fiber strand of said core;

an adhesive layer positioned radially outwardly of said core and comprising a thermoplastic fiber strand wrapped about said core in a direction opposite to the direction of said wire strand wrapped about said synthetic fiber strand of said core;

a primary core containment barrier positioned radially outwardly of said adhesive layer and comprising a synthetic fiber strand wrapped about said adhesive layer in a direction opposite to the direction of said synthetic fiber strand of said adhesive layer; and an outer layer positioned radially outwardly of said primary core containment barrier and comprising a synthetic fiber strand wrapped about said primary core containment barrier in a direction opposite to the direction of said synthetic fiber strand of said primary core containment barrier.

10. The composite yarn of claim 9 wherein said synthetic fiber strand of said core is polyester and said longitudinal wire strand and said wire strand wrapped about said synthetic fiber strand of said core are stainless steel;

said thermoplastic fiber strand of said adhesive layer is polyethylene;

said synthetic fiber strand of said primary core containment barrier is polyester; and said synthetic fiber strand of said outer layer is polyester.

11. The composite yarn of claim 10 wherein said polyester fiber strand of said core has a denier of about 500 and said longitudinal stainless steel wire strand and said stainless steel wire strand wrapped about said polyester fiber strand of said core have a diameter of about 0.0045 inches;

said polyethylene fiber strand of said adhesive layer has a denier of about 350 and is wrapped about said core at about 7 turns per inch;

said polyester fiber strand of said primary core containment barrier has a denier of about 500 and is wrapped about said adhesive layer at about 9 turns per inch; and said polyester fiber strand of said outer layer has a denier of about 1000 and is wrapped about said primary core containment barrier at about 8 turns per inch.

12. A composite yarn comprising a core comprising at least one longitudinal thermoplastic fiber strand, a longitudinal wire strand and a wire strand wrapped about said at least one thermoplastic fiber strand of said core;

a primary core containment barrier positioned radially outwardly of said core and comprising a synthetic fiber strand wrapped about said core in a direction opposite to the direction of said wire strand wrapped about said thermoplastic fiber strand of said core;

an adhesive layer positioned radially outwardly of said primary core containment barrier and comprising a thermoplastic fiber strand wrapped about said primary core containment barrier in a direction opposite to the direction of said synthetic fiber strand of said primary core containment barrier; and an outer layer positioned radially outwardly of said adhesive layer and comprising a synthetic fiber strand wrapped about said adhesive layer in a direction opposite to the direction of said synthetic fiber strand of said primary core containment barrier.

13. The composite yarn of claim 12 wherein said at least one thermoplastic fiber strand of said core is polyethylene and said longitudinal wire strand and said wire strand wrapped about said at least one thermoplastic fiber strand of said core are stainless steel;

said synthetic fiber strand of said primary core containment barrier is nylon;

said thermoplastic fiber strand of said adhesive layer is polyethylene; and said synthetic fiber strand of said outer layer is nylon.

* * * * *